US009097476B2

(12) United States Patent
Mead et al.

(10) Patent No.: US 9,097,476 B2
(45) Date of Patent: Aug. 4, 2015

(54) PROJECTILE LAUNCHER WITH ROTATABLE CLIP CONNECTOR

(75) Inventors: Raymond Aaron Mead, Pawtucket, RI (US); Brian C. Jablonski, Providence, RI (US); John Michael Falkowski, II, Norwood, MA (US)

(73) Assignee: Hasbro, Inc., Pawtucket, RI (US)

( * ) Notice: Subject to any disclaimer, the term of this patent is extended or adjusted under 35 U.S.C. 154(b) by 374 days.

(21) Appl. No.: 13/481,151

(22) Filed: May 25, 2012

(65) Prior Publication Data

US 2013/0312726 A1 Nov. 28, 2013

(51) Int. Cl.

| | |
|---|---|
| ***F41A 9/00*** | (2006.01) |
| ***F41A 9/63*** | (2006.01) |
| ***F41A 9/68*** | (2006.01) |
| ***F41A 9/26*** | (2006.01) |
| ***F41A 9/74*** | (2006.01) |
| *F41B 4/00* | (2006.01) |

(52) U.S. Cl.

CPC ... *F41A 9/68* (2013.01); *F41A 9/26* (2013.01); *F41A 9/63* (2013.01); *F41A 9/74* (2013.01); *F41B 4/00* (2013.01); *Y10T 29/49826* (2015.01)

(58) Field of Classification Search

CPC ..... F41A 9/68; F41A 9/74; F41A 9/45; F41B 4/00

USPC ..... 124/6, 48, 78, 82; 42/7; 89/33.02

See application file for complete search history.

(56) References Cited

U.S. PATENT DOCUMENTS

| | | | | |
|---|---|---|---|---|
| RE7,188 | E | | 6/1876 | Broadwell |
| 961,511 | A | | 6/1910 | Marble |
| 1,374,757 | A | | 4/1921 | Napier |
| 1,441,975 | A | | 1/1923 | Edelin |
| 2,109,589 | A | | 3/1938 | Horwitt et al. |
| 2,147,208 | A | * | 2/1939 | Nolan ..... 42/49.01 |
| 2,345,031 | A | * | 3/1944 | Carithers ..... 42/18 |
| 2,407,461 | A | * | 9/1946 | Vesely ..... 89/34 |
| 2,646,786 | A | | 7/1953 | Robertson |
| 2,997,924 | A | * | 8/1961 | Rosebush ..... 89/155 |
| 3,119,383 | A | | 1/1964 | Foster |
| 3,167,876 | A | * | 2/1965 | Milroy, Jr. ..... 42/7 |
| 3,244,132 | A | | 4/1966 | Leichner et al. |
| 3,621,828 | A | | 11/1971 | Hansen |
| 3,968,783 | A | | 7/1976 | Pfotenhauer |
| 4,115,943 | A | * | 9/1978 | Musgrave ..... 42/90 |
| 4,170,215 | A | | 10/1979 | Kettlestrings |
| 4,248,202 | A | | 2/1981 | Jaworski et al. |
| 4,447,976 | A | * | 5/1984 | Cooper ..... 42/49.02 |
| 4,524,673 | A | * | 6/1985 | Golden ..... 89/33.02 |
| 4,619,063 | A | * | 10/1986 | Hill et al. ..... 42/7 |

(Continued)

*Primary Examiner* — Melba Bumgarner

*Assistant Examiner* — Alexander Niconovich

(74) *Attorney, Agent, or Firm* — Perry Hoffman

(57) ABSTRACT

A toy launcher apparatus with a rotatable clip connector mounted to a lower portion of a housing. The housing also includes an upper portion, a barrel portion and a grip portion. Pivotally mounted to the upper portion of the housing is a handle and mounted to the grip portion is a trigger and a switch. Attached to the clip connector may be eight projectile clips and the clip connector is rotatable 45° every time the handle is pivoted forward. Mounted within the housing are a battery compartment, and a wheel and motor assembly. Batteries in the battery compartment may power the wheel and motor assembly after the switch is activated by a user. Pulling the trigger causes a projectile, such as a foam dart, to be pushed from a clip aligned with the barrel portion toward spinning wheels of the wheel and motor assembly, and the wheels cause discharge the dart.

20 Claims, 7 Drawing Sheets

(56) References Cited

U.S. PATENT DOCUMENTS

| | | | | | |
|---|---|---|---|---|---|
| 4,628,627 | A | * | 12/1986 | Johnson | 42/90 |
| 4,659,320 | A | | 4/1987 | Rich et al. | |
| 4,707,941 | A | * | 11/1987 | Eastman | 42/50 |
| 4,840,110 | A | * | 6/1989 | Fischer | 89/46 |
| 4,982,650 | A | | 1/1991 | Bender-Zanoni et al. | |
| 5,156,137 | A | * | 10/1992 | Clayton | 124/27 |
| 5,159,136 | A | * | 10/1992 | Marsh | 42/71.01 |
| 5,267,549 | A | | 12/1993 | Webber | |
| 5,292,134 | A | | 3/1994 | Schlundt et al. | |
| 5,343,850 | A | | 9/1994 | Steer | |
| 5,373,833 | A | | 12/1994 | D'Andrade | |
| 5,377,656 | A | | 1/1995 | Lewinski et al. | |
| 5,433,646 | A | | 7/1995 | Tarng | |
| 5,471,967 | A | * | 12/1995 | Matsuzaki et al. | 124/6 |
| 5,476,087 | A | | 12/1995 | Kunimoto | |
| 5,515,837 | A | | 5/1996 | Nin et al. | |
| 5,529,050 | A | | 6/1996 | D'Andrade | |
| 5,535,729 | A | | 7/1996 | Griffin et al. | |
| D375,778 | S | * | 11/1996 | Hasselbusch | D22/116 |
| 5,605,140 | A | * | 2/1997 | Griffin | 124/59 |
| 5,611,322 | A | * | 3/1997 | Matsuzaki et al. | 124/6 |
| 5,615,506 | A | * | 4/1997 | Jackson et al. | 42/50 |
| 5,711,285 | A | * | 1/1998 | Stewart et al. | 124/67 |
| 5,996,564 | A | * | 12/1999 | Kotowski | 124/6 |
| 6,224,457 | B1 | * | 5/2001 | Wu | 446/473 |
| 6,279,562 | B1 | | 8/2001 | Clayton | |
| 6,598,329 | B1 | | 7/2003 | Alexander | |
| 6,733,356 | B2 | | 5/2004 | Lee | |
| 6,796,074 | B1 | * | 9/2004 | Obong | 42/90 |
| 7,073,285 | B2 | * | 7/2006 | Obong | 42/90 |
| 7,194,837 | B2 | * | 3/2007 | Obong | 42/90 |
| 7,287,526 | B1 | | 10/2007 | Bligh et al. | |
| 7,418,797 | B1 | | 9/2008 | Crose | |
| 7,437,847 | B1 | | 10/2008 | Mabry | |
| 7,481,209 | B1 | | 1/2009 | Bligh et al. | |
| 7,552,557 | B1 | | 6/2009 | Mabry | |
| 7,673,624 | B2 | * | 3/2010 | Rosella, Jr. | 124/10 |
| 7,975,420 | B2 | * | 7/2011 | Pestana | 42/90 |
| 8,640,374 | B1 | * | 2/2014 | Reichelt | 42/90 |
| 2006/0242880 | A1 | | 11/2006 | Griffin | |
| 2011/0113668 | A1 | * | 5/2011 | Pestana | 42/90 |
| 2011/0146645 | A1 | | 6/2011 | Ma | |

* cited by examiner

PROJECTILE LAUNCHER WITH ROTATABLE CLIP CONNECTOR

FIELD OF THE INVENTION

The present invention relates generally to a toy projectile launcher, and, more particularly, to a toy projectile launcher with a rotatable clip connector where each clip is capable of holding multiple projectiles thereby giving the launcher great projectile capacity.

BACKGROUND OF THE INVENTION

Cartridge and projectile feeders or magazines for real and toy guns have long been known and are disclosed in a number of earlier patents. By way of example, U.S. Pat. No. 7,188 for "Feeders For Repeating Fire-Arms" issued in 1876 to Broadwell and purports to disclose a cartridge filled rotatable cylinder for placement atop a multi-barrel Gatling gun. Cartridges are arranged radially in stacked columns. When a stack is positioned above a delivery opening, the cartridges drop to a lip structure and into a barrel. The lip structure prevents premature entry of a cartridge into a barrel. At the top of each stack are a movable weight and a spring. U.S. Pat. No. 2,345,031 for a "Multiple Clip Magazine For Rifles" issued in 1944 to Carither purports to disclose an enlarge magazine holding multiple columns of multiple cartridges. The magazine has a central slot for directing cartridges to the rifle. Each column slides into location beneath the slot by manipulation of the operator as a preceding column is emptied. A spring is also manipulated by the operator and is placed beneath each repositioned fresh column to bias cartridges into the rifle.

A "Cylindrical Object Ejecting Apparatus" was patented in 1953 by Robertson, U.S. Pat. No. 2,646,786, and purports to describe a rotatable drum located in an aircraft, the drum holding Sono buoys that are successively ejected from the aircraft. The buoys are used to detect submarines. The drum is rotated to a discharge position from which ejector arms rotate to push a buoy out of an opening in the body of the aircraft. Three U.S. Patents, U.S. Pat. No. 3,119,383, issued in 1964 to Foster for a "Target Throwing Apparatus, U.S. Pat. No. 3,244,132, issued in 1966 to Leichner and others for a "Target Throwing Trap" and U.S. Pat. No. 3,621,828, issued in 1971 to Hansen for a "Target Projecting Device With Magazine Indexing Mechanism," all purport to disclose target-throwing devices including a drum or platform where multiple stacks of clay pigeons are arranged about a periphery. Each stack is positioned such that the lowest clay pigeon in the stack is engagable by a throwing arm.

U.S. Pat. No. 4,524,673, entitled "Gun Powered Ammunition Magazine" issued in 1985 to Golden and purports to disclose a magazine for small arms which utilizes power from the weapon to drive ammunition rounds into the weapon. The magazine is a generally cylindrical housing storing about a hundred rounds in a multi-layer arrangement, each layer being aligned along radii of the housing. A patent entitled "Revolving Magazine For Pistols" issued to Hill and Spector in 1986, U.S. Pat. No. 4,619,063, and purports to disclose a revolving cylindrical magazine with a plurality of radial chambers, each for holding a stack of cartridges. A knob is provided to rotate the magazine to align each chamber with a barrel of the gun. In 1989, a U.S. Pat. No. 4,840,110, was granted to Fischer for a "Device For Storing Loading Ammunition In A Turret." The Fischer patent purports to disclose a revolving magazine for a battle tank in which the magazine included radial chambers with spring loaded abutments for the stored shells. A chain-drive lifting device moves shells from the magazine to a main firing tube.

A "Modular Ammunition Packaging And Feed System" for a Gatling-type gun was patented in 1991 by Bender-Zanoni, U.S. Pat. No. 4,9082,650. The system includes a mechanized support frame for holding multiple magazine packs, one to each side of the linearly arranged frame where each pack is loaded with cartridges. The frame is connected to the gun by a flexible chute and a pack drive system is built into the frame. Loading is accomplished by replacing an empty pack on the frame with a loaded pack. U.S. Pat. No. 5,156,137, for a "Projectile Launcher," in the form of a revolving magazine for shooting suction cup darts issued in 1992 to Clayton. Each dart when loaded into the magazine compressed a spring that was retained by a lever with a hook end, and the spring was released when the trigger was pulled. In 1995, U.S. Pat. No. 5,471,967 issued to Matsuzaki and Ishida for a "Disc Discharging Toy." The patent purportedly discloses the firing of soft discs mounted in a cylindrical magazine. Discharge occurs by passing each disc between a battery powered spinning roller and an idler roller. In 1999, a U.S. Patent for a "Skeet Throwing Device" was issued to Kerr, U.S. Pat. No. 5,947,101, and purports to disclose a cylindrical housing for a plurality of skeet members that are discharged by two spinning tires.

Other devices using spinning wheels are disclosed in U.S. Application Publication No. 2002/0166551, entitled "Toy Projectile Launcher" listing Lee as an inventor, and U.S. Pat. No. 6,523,535, issued to Rehkemper and others in 2003 having the same title as the Lee Application. Both devices are toy guns for firing soft darts where multiple darts are stored in a clip or in a chute. Another U.S. Application Publication No. 2011/0113668, entitled "Multi-Clip Magazine Assembly For Rifles" listing Pestana as an inventor and purports to disclose a triangular shaped connector for engaging three cartridge clips, one clip mounted to each of the three sides of the connector. A coupling held by a screw holds the connector and magazines together when mounted to a rifle. When a magazine is empty and malfunctions, the screw may be loosened, the empty or malfunctioning magazine removed and a new loaded magazine mounted unto the connector.

These patents and applications and the devices disclosed are of some interest, however, they do not teach an efficient, simply constructed apparatus as disclosed in detail below.

SUMMARY OF THE INVENTION

In accordance with the present invention, an advantageous method and system are described in the form of a projectile launcher with a rotatable clip connector, the clip connector for holding multiple clips, and each clip holding multiple projectiles, such as foam darts. The projectile launcher is simply constructed, structurally robust, compact, easily operated, relatively inexpensive and fun to use. What is more is that the number of projectiles available for discharge is huge.

Briefly summarized, the invention relates to a projectile launcher including a housing having upper and lower portions, a rotatable clip connector connected to the lower portion of the housing, the clip connector having a plurality of recesses, each of the plurality of recesses structured and dimensioned to receive a projectile clip, and a movable structure mounted to the housing and operatively connected to the clip connector for causing rotation of the clip connector to enable alignment of a clip for discharge of a projectile.

The invention also relates to a method for making a projectile launcher with a rotatable clip connector including the steps of forming a housing with an upper portion, a lower portion, a barrel portion and a grip portion, connecting a rotatable clip connector to the lower portion of the housing, pivotally mounting a handle to the upper portion of the housing, operatively connecting the handle to the clip connector to enable rotation of the clip connector by movement of the handle, mounting a trigger to the grip portion of the housing, mounting structure to the housing to enable a projectile to be discharged, and connecting the trigger to operatively cooperate with the structure to enable a projectile to be discharged.

BRIEF DESCRIPTION OF THE DRAWINGS

For the purpose of facilitating an understanding of the invention, the accompanying drawings and detailed description illustrate an embodiment thereof, from which the structures, construction and operation, processes, and many related advantages of the embodiment may be readily understood and appreciated.

DESCRIPTION OF THE EMBODIMENTS

The following description is provided to enable those skilled in the art to make and use the described embodiment set forth. Various modifications, equivalents, variations, and alternatives, however, will remain readily apparent to those skilled in the art. Any and all such modifications, variations, equivalents, and alternatives are intended to fall within the spirit and scope of the present invention defined by the below listed claims.

Figure 1:
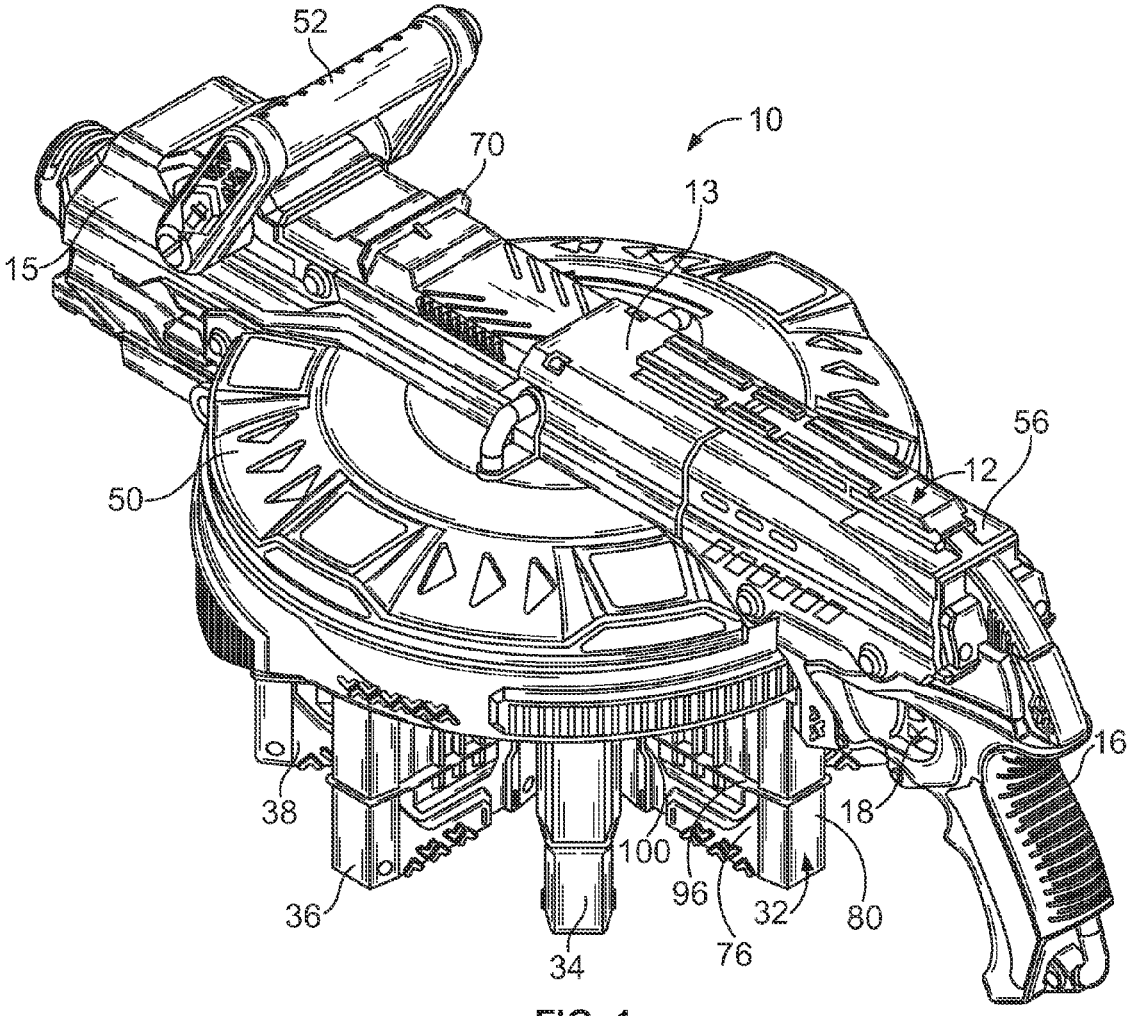
FIG. 1 is a downward looking isometric view, generally from the rear, of a projectile launcher featuring a rotatable clip connector.
Figure 2:
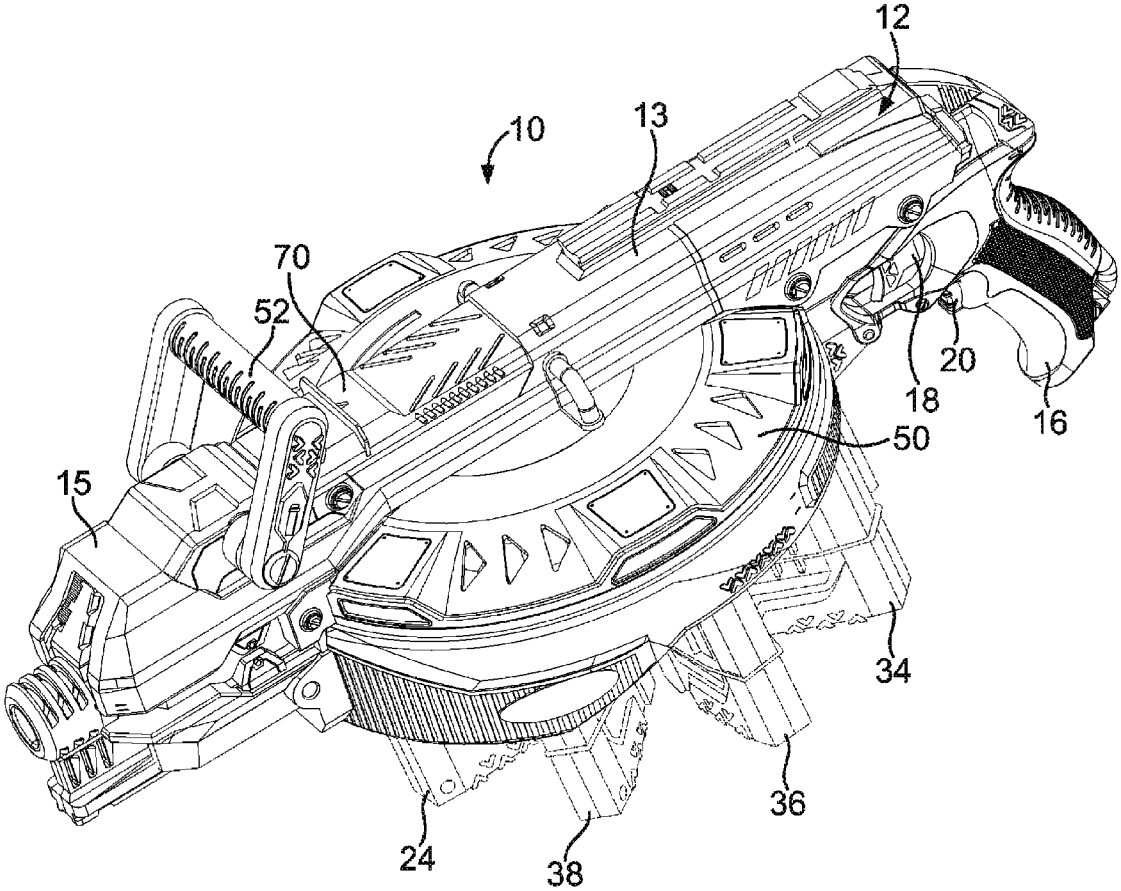
FIG. 2 is a downward looking isometric view, generally from the front, of the projectile launcher illustrated in FIG. 1.
Figure 3:
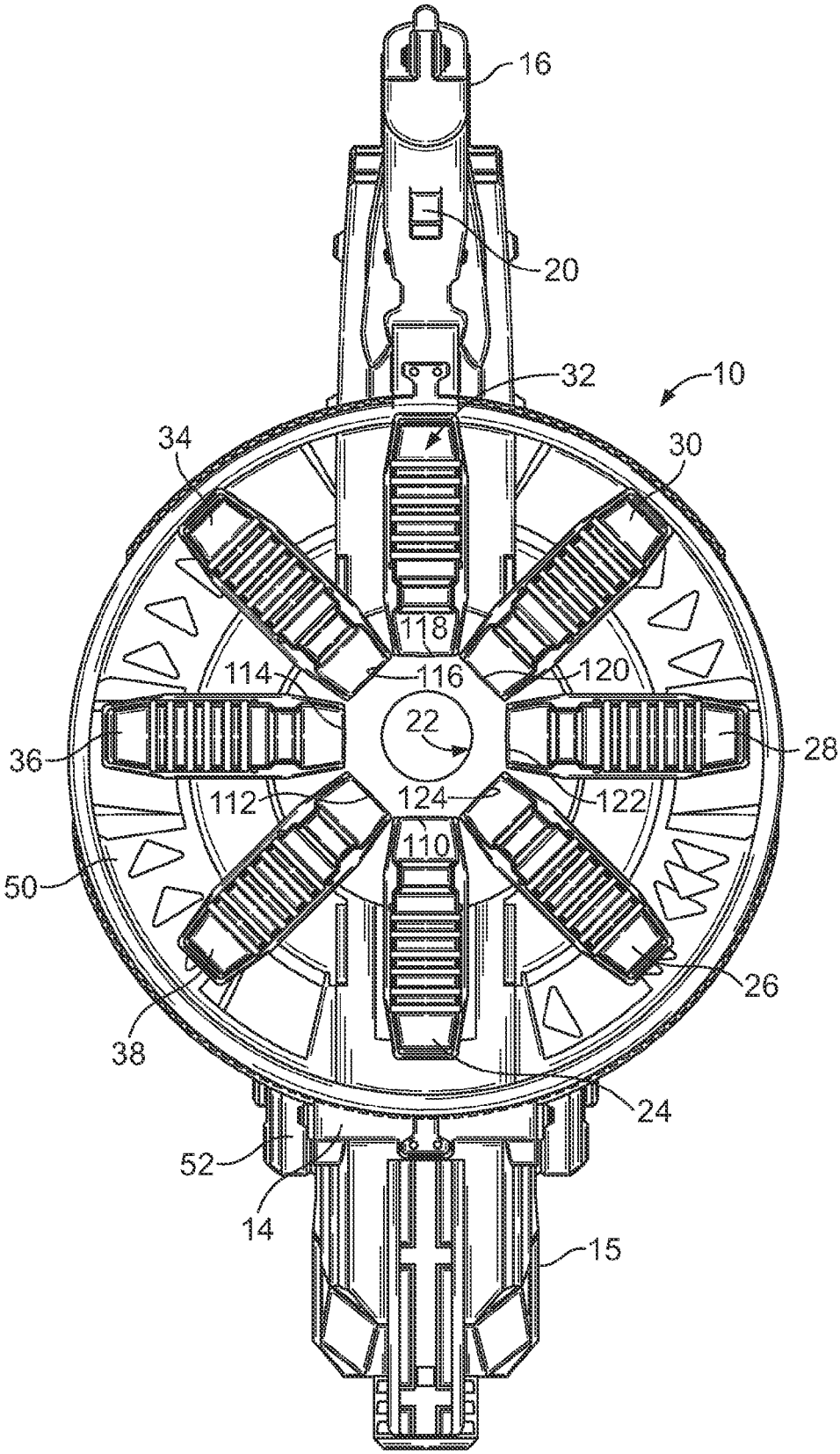
FIG. 3 is a bottom plan view of the projectile launcher illustrated in FIGS. 1 and 2.

Referring now to FIGS. 1-3, a toy projectile launcher, gun or blaster 10 is illustrated having a housing 12 including an upper portion 13, a lower portion 14, a barrel portion 15 and a grip portion 16. A trigger 18 is mounted to the grip portion 16, as is a power switch 20, located below the trigger. Extending downward from the lower portion 14 of the housing is a rotatable clip holder or connector 22 to which may be mounted eight projectile clips 24, 26, 28, 30, 32, 34, 36, 38. Each projectile clip contains a plurality of projectiles in the form of cartridges, or more commonly for toys, darts made of NERF™ brand foam, a solid, spongy cellular material, such as the dart 40 illustrated in FIG. 4. A circular cover or clip shield 50 extends over the clip connector 22 and the clips 24, 26, 28, 30, 32, 34, 36, 38. Mounted to the barrel portion 15 of the housing 12 and extending upward from the housing is a pivotal structure in the form of a handle 52 to be used for rotating the clip connector. In the alternative, instead of the upwardly extending handle, the toy launcher may have a side or top mounted lever or a bottom mounted grip or similar structure. Also in the alternative, the toy launcher may be constructed to discharge other types of projectiles, such as foam discs, washers, balls, or non-foam paint balls, and the launcher apparatus may even be a real gun with real cartridges stored in real non-toy clips.

The darts are discharged from the barrel portion 15 by a wheel and motor assembly 54, FIG. 4, mounted in the housing 12 generally below the handle 52. The wheel and motor assembly 54 may include two wheels (not shown) in close proximity to each other, a little less than the diameter of a dart, that are caused to spin by a motor powered by batteries mounted in a battery compartment 56 above the grip portion 16 of the housing. Electrical power is sent from the batteries (not shown) to the motor (not shown) after a user activates the power switch 20. Wheel and motor assemblies are well known to those with skill in art. Both wheels of the wheel and motor assembly 54 may be powered or only one wheel is powered and the other wheel is an idler.

Figure 4:
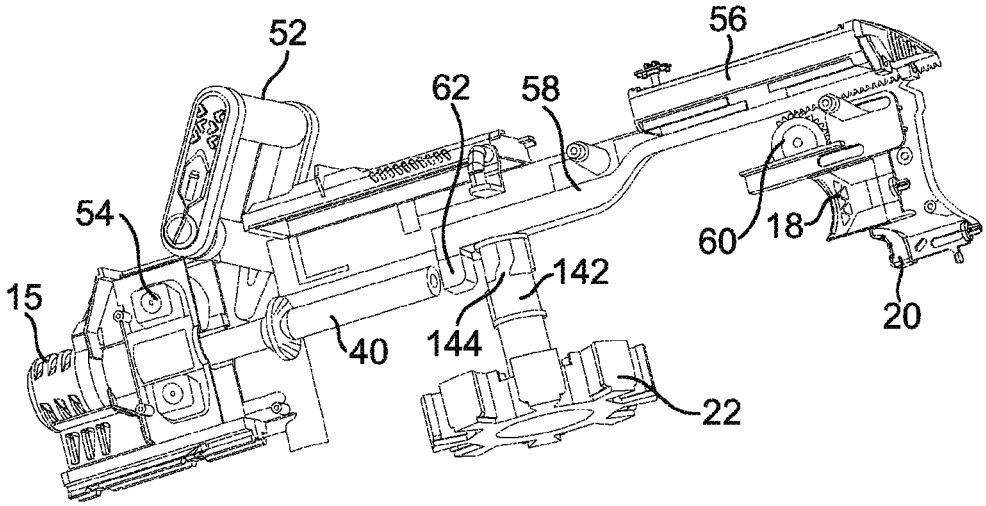
FIG. 4 is an isometric view of the projectile launcher without a housing.

The trigger 18 is connected to a push link 58, FIG. 4, by a gear 60 and the push link 58 includes a depending finger 62 that engages the back end of each dart, such as the dart 40, when the trigger 18 is pulled rearward by the user. Pulling the trigger 18 rearward rotates the gear 60 counterclockwise to force the push link 58 forward. Forward movement of the link finger 62 pushes the dart 40 into the space between the wheels, and the spinning wheels impart energy to the dart to cause the dart to be discharged. A sliding panel 70, FIGS. 1 and 2, is mounted in the upper portion 13 of the housing 12 to allow access to darts that may become jammed.

Figure 5:
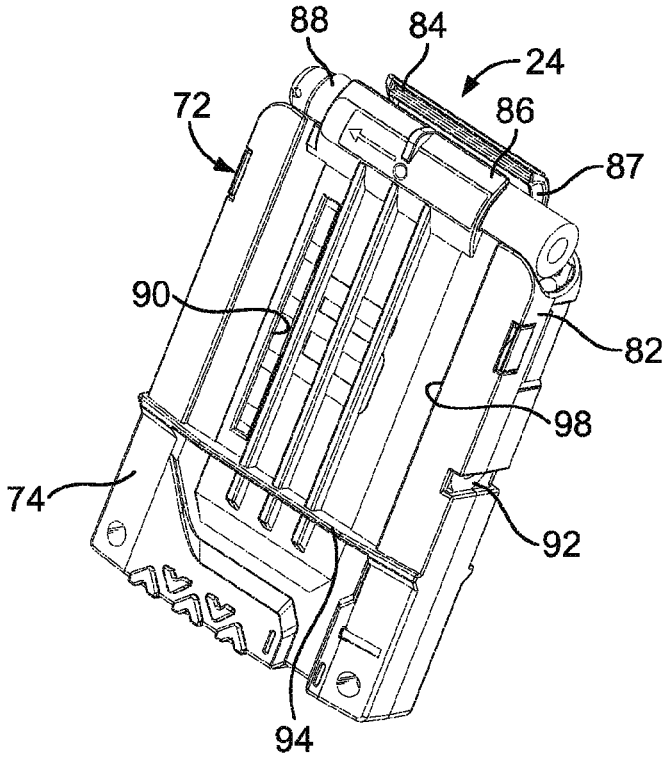
FIG. 5 is an isometric view of a projectile loaded clip for use with the rotatable clip connector of the projectile launcher.
Figure 7:
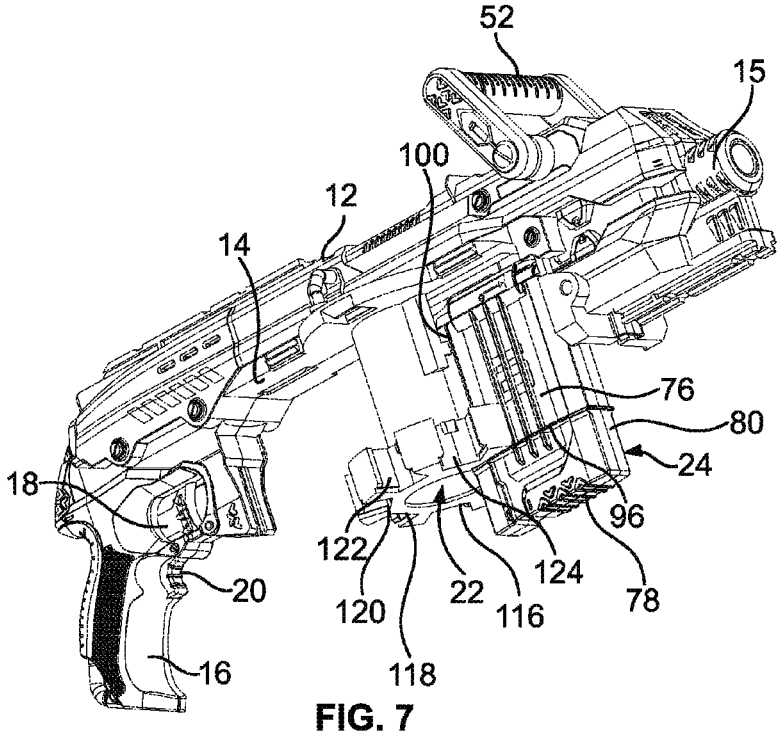
FIG. 7 is an upward looking isometric view of the projectile launcher illustrated in FIG. 6.
Figure 8:
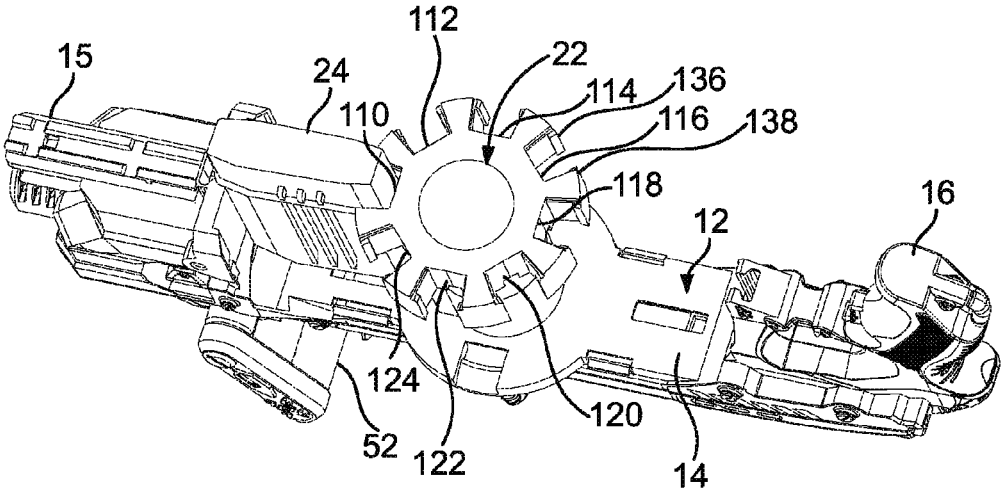
FIG. 8 is a bottom isometric view of the projectile launcher illustrated in FIGS. 6 and 7.

Each clip, such as the clip 32, FIG. 5, is configured as a case 72 with a generally rectangular cross section, two sidewalls, such as the left sidewall 74, FIG. 5, and the right sidewall 76, FIG. 7, a bottom wall, such as the bottom wall 78, FIG. 7, and two end walls, such as the front end wall 80, FIG. 7 and the rear end wall 82, FIG. 5. The case 72, FIG. 5, includes an open top 84 with arcuate lips 86, 87 to loosely grip the uppermost dart 88 of a stack of darts loaded into the case 72. Inside each case are a spring and a follower structure (not shown) for biasing the stack of darts upward in the case in the usual manner and well known to those having skill in the art. A vertical slot 90 in the left sidewall 74 enables a user to determine at a glance the number of darts remaining in the clip. A recess 92 is formed in the rear end wall 82 to facilitate engagement with the clip connector 22 as do horizontal flanges 94, FIG. 5, and 96, FIG. 7, and two vertical ledges, 98, FIG. 5, and 100, FIG. 7, one each in the sidewalls 74, 76, respectively. The clip may be constructed to store any number of darts as a function of the length and/or width of the clip. Two such clips found preferable store seven and eighteen darts. Thus, the number of darts available for play is considerable.

Figure 6:
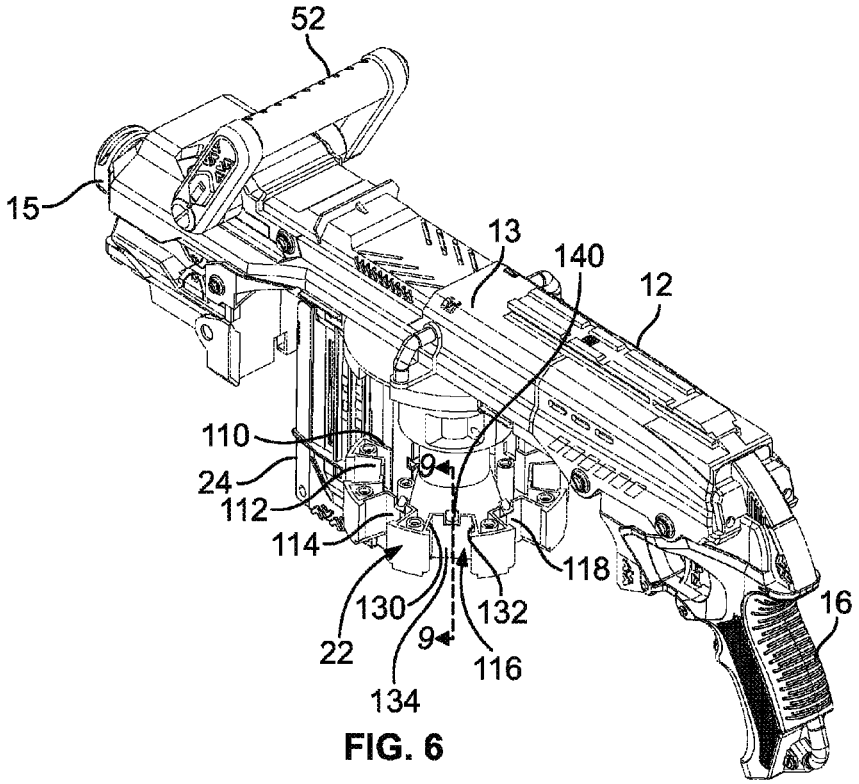
FIG. 6 is a downward looking isometric view of the projectile launcher without a shield and seven of eight clips.
Figure 9:
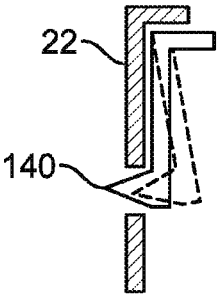
FIG. 9 is a section view taken along line 9-9 of FIG. 6.

The clip connector 22 is connected to the lower portion 14 of the housing 12 and is generally cylindrical in shape with eight spaced-apart indentations or recesses 110, 112, 114, 116, 118, 120, 122, 124, FIGS. 3 and 6-8, in the periphery of the clip connector. Each recess is structured and dimensioned to slidably receive and engage a clip as shown with the clip 24 in the recess 110. Each recess has two sidewalls and a base wall, such as the sidewalls 130, 132, FIG. 6, and the base wall 134 of the recess 116, and a pair of flanges extending from the sidewalls, such as the flanges 136, 138, FIG. 8. A resilient tab, such as the tab 140, FIGS. 6 and 9, is located in the base wall of each recess, such as the base wall 134, for engagement with the recess in the clip, such as the clip recess 92, FIG. 5, of the clip 24. Movement of the tab, shown in dotted line, occurs as the tab is engaged by the rear end wall 82 of the clip and forced inward or to the right in the drawing, FIG. 9, until the recess 92 of the clip is aligned. When the recess 92 is aligned the tab 140 springs back to weakly lock the clip in place. To remove a clip from the clip connector the user pulls downward on the clip and the edge border of around the recess 92 pushes the tab 140 out of engagement.

Mounted to the lower portion 14 of the housing 12 and connected to the clip connector 22 so as to connect the clip connector to the housing is a transmission cylinder 142, FIG. 4, with curved surface grooves, such as the groove 144, for causing the clip connector to rotate each time the handle 52 is operated. With eight recesses in the clip connector 22, the transmission grooves are constructed and spaced to rotate 45° each time the handle is pivoted. The shield 50, FIGS. 1-3, is mounted to the lower portion 14 of the housing 12 to provide top and side protection for the rotating clips and the stacked darts in the clips, especially when the handle is operated and the clip connector is rotated. In the alternative, the clip connector may have more or less than eight recesses and the clips may be wider and/or longer than illustrated. It is also to be noted that even though the clip connector may have eight recesses, less than eight clips may be attached at any one time. For example, a user may use only four clips to lessen the weight of the launcher, or the user may only have four clips (or any other number less than eight) available for play.

Figure 10:
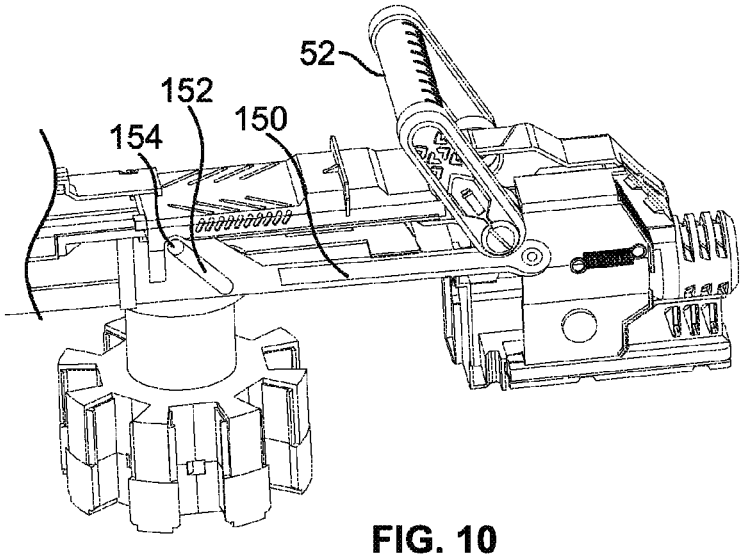
FIG. 10 is a downward looking isometric view of a portion of the projectile launcher without the housing, the shield and the eight clips.

The handle 52 is pivotally mounted to the upper portion 13 of the housing 12 and is connected to one end of an elongated link 150, FIG. 10. At the opposite end, the elongated link has a slanted slot 152. A pin 154 rides in the slot 152 such that when the handle 52 pivots forward, the elongated link moves longitudinally, usually horizontally, rearward and the pin is forced to move laterally, usually in a vertical downward direction. The pin 154 also rides in the curved surface grooves, such as the surface groove 144, of the transmission cylinder 142 such that the curved grooves translates the vertical motion of the pin to rotational motion of the transmission cylinder 142 and the attached clip connector 22 to cause the 45° rotation of the clip connector from alignment of one recess (and hence one clip, such as an empty clip) with the barrel portion 15, to alignment of another recess (and hence another clip, such as a full clip) with the barrel portion. The grooves may be designed to cause rotation of more or less than 45° should more or less recesses be formed in the clip connector.

In the alternative, the launcher may not be powered by batteries, but use instead a piston moving in a cylinder and include a second handle, a lever or similar element to cock a compression spring biasing the piston. Pulling the trigger releases the spring causing a blast of compressed air to discharge the projectile. The launcher 10 may be made of plastic or plastic and metal.

In operation, the user loads each clip with darts and then slides each clip into engagement in a recess of the clip connector 22. In the projectile launcher illustrated, eight clips may be engaged to the clip connector although less than the eight clips, as few as one clip, for example, may be engaged at any one time, if desired by the user. It is also noted that clips may be removed and/or added at any time during play. To discharge darts from the launcher, the user presses the switch 20 to power the wheel and motor assembly 54 and cause the wheels to spin. The projectile launcher may be held in many different ways, but one convenient way is for one hand of the user to grip the handle 52 and the other hand to hold the grip portion 16 with a finger on the trigger 18. When the trigger is pushed rearward the upper most dart of an aligned clip is pushed toward the spinning wheels of the wheel and motor assembly and the wheels propel the dart away from the launcher. The user may continue to activate the trigger until the aligned clip is emptied of darts, or the user may fire a dart, rotate the clip connector and fire again, or the user may fire a few darts and then rotate the clip connector.

Rotation of the clip connector may continue every time the handle is pivoted forward in that the user may discharge a dart, pivot the handle three times to rotate the clip connector 135° and then discharge another dart or multiple darts. Or, if the user is using only four clips spaced evenly around the clip connector, he/she may discharge a dart, pivot the handle twice to rotate the clip connector 90° and discharge another dart. Operating the handle twice skips the recess to which no clip is attached. Under any circumstances, the user pivots the handle forward to cause the clip connector to rotate from one aligned recess and clip to another recess and clip aligned with the barrel portion. At any time during play, an empty or damaged clip may be removed and replaced with a full clip.

It is noted that throughout this description, words such as "forward," "rearward," "upward," "downward," "upper," and "lower," as well as like terms, refer to portions or elements of the launcher apparatus as they are viewed in the drawings relative to other portions or in relationship to the positions of the apparatus as it will typically be held and moved during play when operated by the user, or to movements of elements based on the configurations illustrated.

The launcher apparatus disclosed in detail above provides for a launcher having great dart capacity and yet operates easily in a simple, effective and safe manner, and yet the projectile launcher has a robust, but relatively simple structure that may be produced at a reasonable cost.

Figure 11:
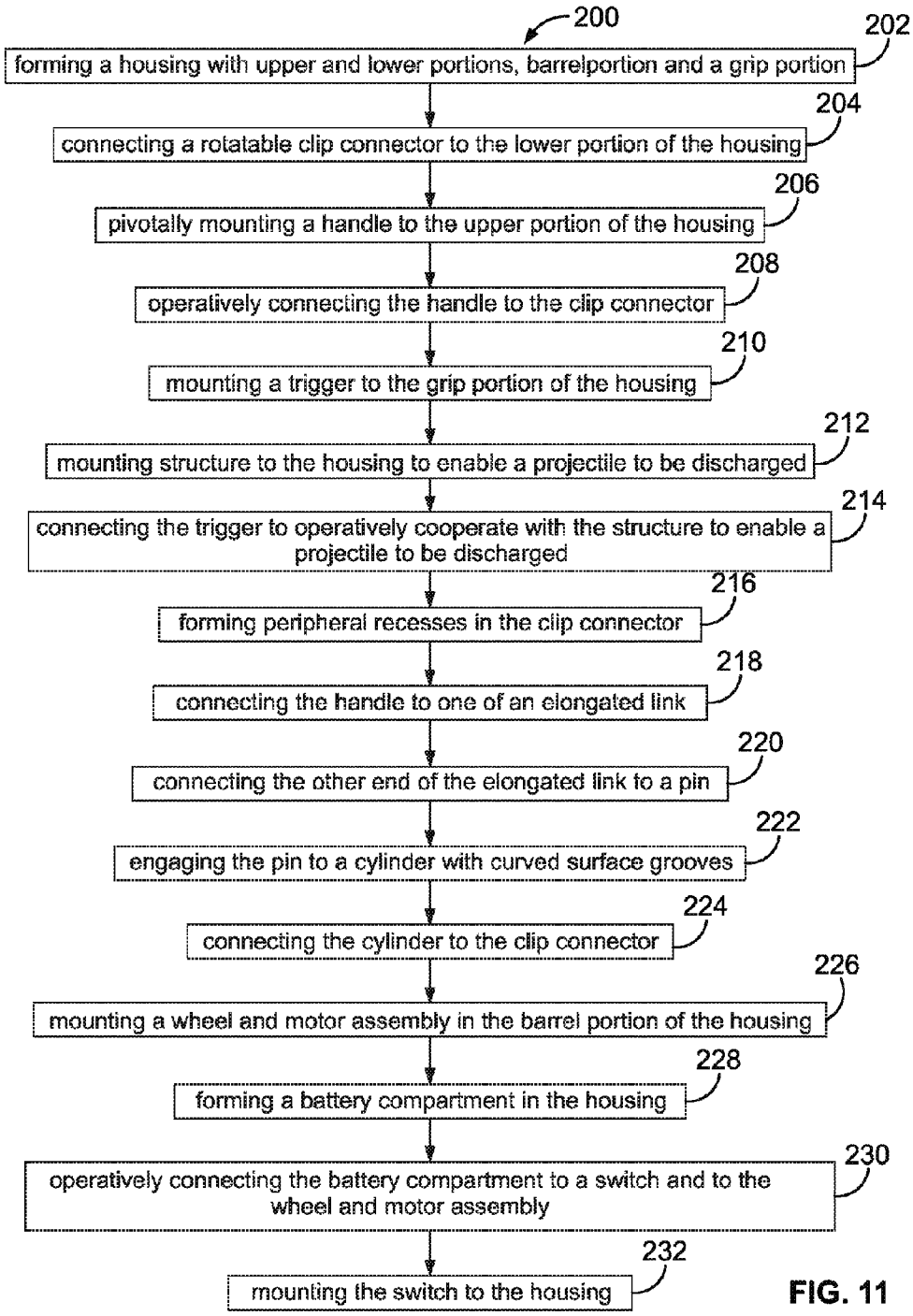
FIG. 11 is a flow diagram for a method of making the projectile launcher with the rotatable clip connector.

The present invention also includes a method 200, FIG. 11, for making the projectile launcher 10 including the steps of forming the housing 202 with the upper portion, the lower portion, the barrel portion and the grip portion, connecting the rotatable clip connector 204 to the lower portion of the housing, pivotally mounting the handle 206 to the upper portion of the housing, operatively connecting the handle 208 to the clip connector to enable rotation of the clip connector by movement of the handle, mounting the trigger 210 to the grip portion of the housing, mounting structure to the housing, such as the wheel and motor assembly, to enable a projectile to be discharged 212 and connecting the trigger 214 to operatively cooperate with the structure to enable a projectile to be discharged. The method may also include the steps of forming peripheral recesses in the clip connector 216, each peripheral recess for receiving a projectile clip, connecting the handle 218 to one end of the elongated link, connecting the other end of the link to the pin 220, connecting the pin to the transmission cylinder 222 with the curved surface grooves, and connecting the transmission cylinder 224 to the clip connector, mounting a wheel and motor assembly 226 in the barrel portion of the housing, forming a battery compartment 228 in the housing, operatively connecting the battery compartment 230 and batteries in the battery compartment to a switch and to the wheel and motor assembly, and mounting the switch 232 to the housing.

From the foregoing, it can be seen that there has been provided structure and features for a projectile or dart launcher apparatus with a rotatable clip connector that is safe, fun to use, simple to construct and robust in structure, as well as a disclosure for the method of the making the projectile launcher apparatus with a huge dart capacity. While a particular embodiment of the launcher apparatus has been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A projectile launcher comprising:

a housing having upper and lower portions;

a rotatable clip connector connected to the lower portion of the housing, the clip connector having a plurality of recesses, each of the plurality of recesses structured and dimensioned to receive a projectile clip, the projectile clip being configured as a separately connectable case for holding multiple projectiles therein; and a movable structure mounted to the housing and further including a linkage operatively connected to the clip connector for causing rotation of the clip connector to enable alignment of a clip for discharge of a projectile.

2. The projectile launcher of claim 1, wherein:

the movable structure is a pivotal handle mounted to the upper portion of the housing.

3. The projectile launcher of claim 1, including:

a circular shield mounted to the lower portion of the housing and positioned above the plurality of recesses of the clip connector.

4. The projectile launcher of claim 1, including:

at least one projectile clip mounted in a recess of the plurality of recesses of the clip connector.

5. The projectile launcher of claim 1, wherein:

the housing includes a barrel portion and a grip portion.

6. The projectile launcher of claim 5, including:

a trigger mounted in the grip portion of the housing.

7. The projectile launcher of claim 5, including:

a wheel and motor assembly mounted to the barrel portion of the housing.

8. The projectile launcher of claim 7, including:

a battery compartment formed in the housing; and a switch for operatively connecting a battery in the battery compartment with the wheel and motor assembly.

9. The projectile launcher of claim 1, wherein:

the movable structure is a pivotal handle mounted to the upper portion of the housing; and including:

a circular shield mounted to the lower portion of the housing and positioned above the plurality of recesses of the clip connector.

10. The projectile launcher of claim 9, wherein:

the housing includes a barrel portion and a grip portion; and including:

a trigger mounted in the grip portion of the housing; and a wheel and motor assembly mounted to the barrel portion of the housing.

11. The projectile launcher of claim 10, including:

a battery compartment formed in the housing; and a switch for operatively connecting a battery in the battery compartment with the wheel and motor assembly.

12. The projectile launcher of claim 1, wherein:

the projectile clip is receivable at any one of the plurality of recesses allowing other projectile clips to be received at other recesses.

13. A projectile launcher comprising:

a housing having an upper portion, a lower portions, a barrel portion and a grip portion;

a rotatable clip connector connected to the lower portion of the housing, the clip connector having a plurality of recesses, each of the plurality of recesses structured and dimensioned to receive a projectile clip, the projectile clip being configured as a separately connectable case for holding multiple projectiles therein; and a movable structure mounted to the housing and further including a linkage operatively connected to the clip connector for causing rotation of the clip connector to enable alignment of a clip with the barrel portion for discharge of a projectile.

14. The projectile launcher of claim 13, including:

a circular shield mounted to the lower portion of the housing and positioned above the plurality of recesses of the clip connector.

15. The projectile launcher of claim 14, wherein:

the movable structure is a pivotal handle mounted to the upper portion of the housing.

16. The projectile launcher of claim 15, including:

a trigger mounted in the grip portion of the housing; and a wheel and motor assembly mounted to the barrel portion of the housing.

17. The projectile launcher of claim 16, including:

a battery compartment formed in the housing; and a switch for operatively connecting a battery in the battery compartment with the wheel and motor assembly.

18. The projectile launcher of claim 13, wherein:

the rotatable clip connector connected to the lower portion of the housing is disposed forward of the grip portion of the housing.

19. A projectile launcher comprising:

a housing;

a clip connector portion connected with the housing for connecting a plurality of projectile clips, each of the plurality of projectile clips being configured as a separately connectable case for holding multiple projectiles therein;

a plurality of recesses defined at the clip connector portion, each of the plurality of recesses structured and dimensioned to receive one of the plurality of projectile clips; and a movable structure mounted to the housing and further including a linkage connected to the clip connector portion for causing rotation of the clip connector portion for enabling alignment of another one of the plurality of projectile clips for discharge of a projectile from said one of the plurality of projectile clips.

20. The projectile launcher of claim 19, wherein:

the clip connector portion connected with the housing is rotatable for connecting the plurality of projectile clips.

* * * * *